US005135293A

United States Patent [19]

St-Germain et al.

[11] Patent Number: 5,135,293

[45] Date of Patent: Aug. 4, 1992

[54] LOCKERS

[75] Inventors: André St-Germain, Sainte-Marthe-sur-le-Lac; Antonio Diaz Torga, Saint-Constant, both of Canada

[73] Assignee: Raymond Sigouin, Ste-Marthe sur le Lac, Canada

[21] Appl. No.: 596,377

[22] Filed: Oct. 12, 1990

[51] Int. Cl.[5] ..... A47B 53/00

[52] U.S. Cl. ..... 312/199; 312/249.2; 312/326

[58] Field of Search ..... 312/351, 283, 285, 324, 312/326, 248, 242, 229, 199

[56] References Cited

U.S. PATENT DOCUMENTS 1,386,500 8/1921 Hile ..... 312/351
2,965,429 12/1960 Stanger ..... 312/242

FOREIGN PATENT DOCUMENTS 0509246 1/1955 Canada ..... 312/326

*Primary Examiner*—Gerald A. Anderson

*Attorney, Agent, or Firm*—Pierre Lespérance

[57] ABSTRACT

A closet, for use as a locker for storage of items such as clothing, school books and the like, consisting of: a closed, hollow, rigid frame, defining top, bottom and front walls, at least one door opening being made in the front wall; a rigid door for each door wall opening, the door being of substantially semi-cylindrical shape; a first disc rotatably mounted to the top wall by a first stem; a second disc rotatably mounted to the bottom wall by a second stem, the second stem being coaxial to the first stem. The door fixed to and surrounding about a half edgewise section of the discs. The door is rotatable about the coaxial items, between a closed position completely closing the door wall opening so as to be convex when viewed from the outside, and an open position substantially clearing the door wall opening. The door is releasably locked in its closed position, the discs and stems thereafter becoming beyond reach. The closet is characterized by its resistance to physical abuse. The closet is provided with a low seat foldable therein. A system is also provided to unlock the closet from the inside.

10 Claims, 10 Drawing Sheets 25
186

24
186
178
193
194

193
178
192
194
194a
196
126

194a
70
193
122
178
36

23
23
186
122
126
190
192
196
70
193

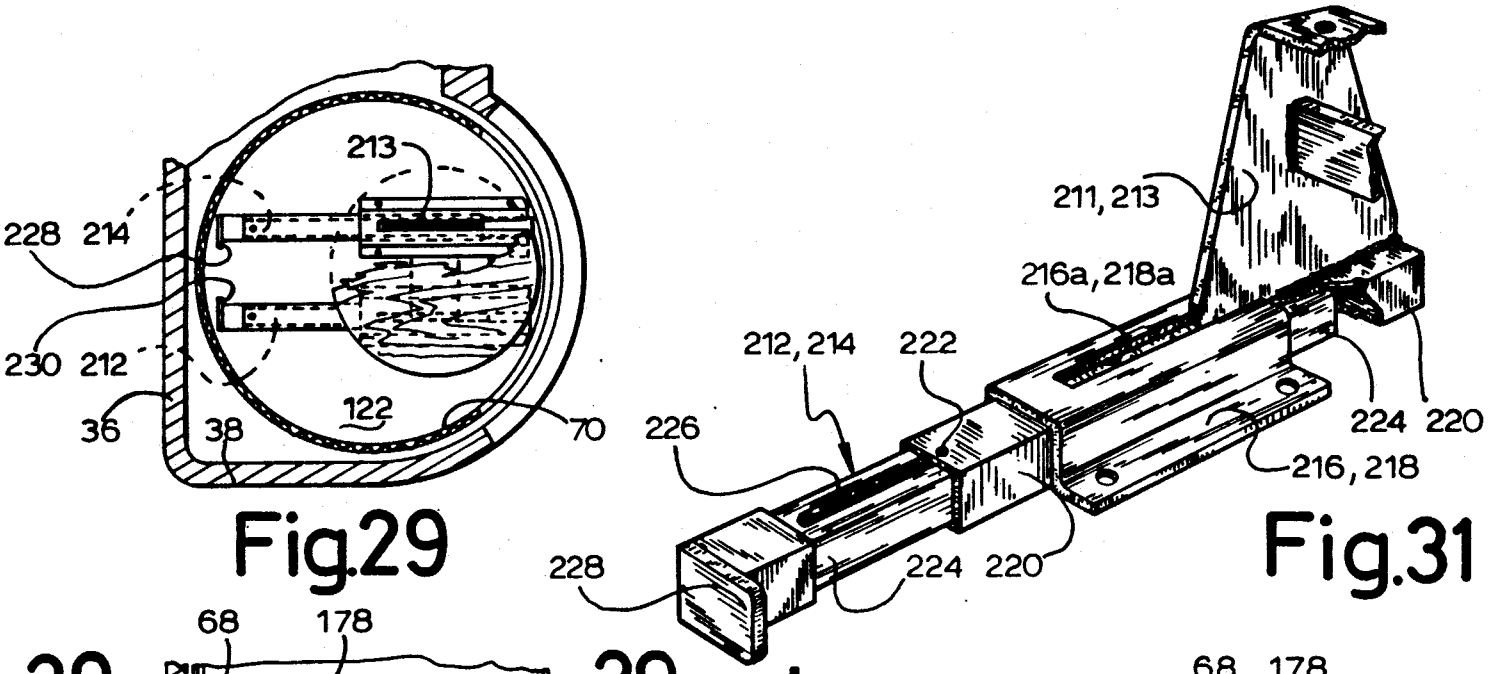
Fig.31
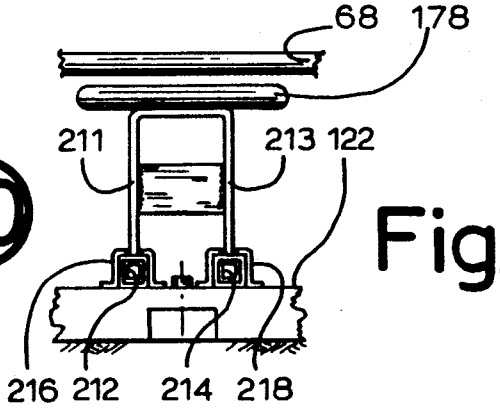
Fig.30
Fig.29
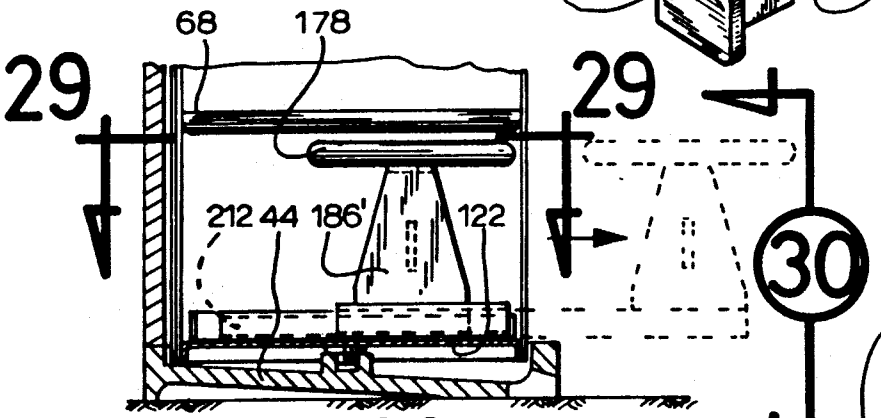
Fig.28

LOCKERS

FIELD OF THE INVENTION

This invention relates to closets such as school lockers.

BACKGROUND OF THE INVENTION

Vandalism, i.e. the willful partial or complete destruction of public or private property, is, it would seem, an increasing problem in industrial countries, or is at least increasingly reported by information media (newspapers, television news broadcasts, . . .). More specifically, the recently unveiled data for yearly reparation costs of public school equipment, particularly personal lockers for high-school students in Canada, indicate that large amounts of money are involved, and provides a troubling insight of the violence developed by adolescents. For instance, in one very large high-school public institution in downtown Montreal, yearly repair costs for personal lockers alone have been reported to be in excess of half a million dollars.

It is believed that part of the problem associated with vandalism is linked to the easinees in obtaining the satisfaction of seeing the object sustaining the physical abuse rapidly destroyed. Indeed, psychology would show that physical abuse on public property provides an outlet for aggressive tendencies of adolescent youths, and a feeling of "success" or great satisfaction comes from becoming aware of the physical strength by the youth through deformation of the structure of the lockers.

To the inventor's knowledge, no significant attempt has been made by closet manufacturers to mass-produce a low-cost yet significantly reinforced locker, specifically for high-school use. Should there be lockers of stronger construction in schools it would be much harder for the students to poke or deform same and thus, a reduced level of satisfaction would result.

However, the urge to vandalize property would not disappear, it would only be shifted elsewhere. Of course, the basic problem remains at a psychological level, since the physical violence is only a symptom of a condition. Unfortunately, further elaboration of these considerations goes beyond the scope of the present invention.

OBJECTS OF THE INVENTION

The prime object of the invention is thus to discourage vandalism by considerably reinforcing the structure of closets such as school lockers.

A corollary object of the invention is to increase the durability of closets.

Another object of the invention is to significantly decrease the maintenance costs of public property in high-schools, mainly public schools but also private one as well.

An object of the invention is to provide a locker as above-described, which is of particularly low cost.

Another object of the invention is to provide foldable seat means which can be fitted inside the closet.

An object of the invention is to provide key means and door lock means to enable controlled access to said closet.

A further object of the invention is to provide handle means to enable a person trapped inside the locker being locked from the outside by the door lock means, to escape from the locker.

SUMMARY OF THE INVENTION

In accordance with the stated objects of the invention, there is disclosed a closet for use as a locker for storage of items such as clothing, school books and the like, consisting of:

(a) a closed, hollow, rigid frame, defining a front wall, at least one door wall opening being made into said front wall;

(b) a rigid door for each said door wall opening, said door being of substantially semi-cylindrical shape; and (c) mounting means, for securing said door to said frame whereby said door is movable relative to said frame between a closed position, completely closing said door wall opening so as to be convex when viewed from the outside, and an open position, substantially clearing said door wall opening.

The door is releasably locked in its closed position, said mounting means thereafter becoming beyond reach. Said closed closet being characterized by its resistance to physical abuse.

Preferably, said closet has top and bottom walls and said mounting means includes:

(a) an upper disc member, having an upwardly-extending transverse shaft rotatably mounted to said top wall spacing the upper disc member from the top wall;

(b) a lower disc member, having a downwardly-extending second shaft rotatably mounted to said bottom wall spacing the lower disc member from the bottom wall and said second shaft is coaxial to said first shaft; and (c) securing means, for anchoring said disc members to said semi-cylindrical door, wherein the latter is rotatable about a common axis of said first and second shafts, and wherein the door opening action shifts the door inside said closed frame to completely disappear therein so as to be concealed.

The opened door will be much less likely to sustain physical abuse from would-be vandals when in said closed frame.

The disc members are saucer-shaped, each defining upturned, curved, peripheral flanges with about a half section being anchored to said door by anchoring means.

Preferably, said saucer-shaped disc members each have a number of through-bores, for passage of water therethrough, whereby these disc members can be used as shelves for supporting clothing (which may be soaked).

It is envisioned that the top face of said closet bottom wall be downwardly inclined or sloped, and further including at least one water drain hole in the front edge section of said closet bottom wall; whereby said disc members through-bores, said closet sloped bottom wall and said drain hole cooperate in evacuating water from said closet.

A large U-shape bracket is made to depend from the underface of said upper disc member, for engagement by one or more coat-hangers for hanging garments.

Advantageously, said closet frame is made from concrete, said top and bottom walls being physically separate from the remaining closet frame but fixedly secured thereto by a number of bolts and nuts, said bolts engaged in countersunk holes in said top and bottom walls, said nuts cavities in said remainder of the closet frame.

Preferably, each door is reinforced by being made from corrugated metal.

It is envisioned that there be at least two door wall openings and a corresponding number of doors, and further including at least two cylindrical storage areas each being constituted within the volume defined by a given semi-cylindrical door, the relative position of said door with respect to its sliding motion run and the length thereof being such that each said storage area remains constantly beyond reach of any adjacent storage area(s).

The length of each door is about 5/4 $\pi$R, where R is the radius of curvature of the door around the saucer-shape disc members.

Preferably, said closet separate concrete bottom wall is anchored to the ground by further bolt means, mounted into a well or cavity made into the side edge of said bottom wall.

BRIEF DESCRIPTION OF THE DRAWINGS

FIG. 28 is a view similar to that of FIG. 20, but for a fourth embodiment of the seat means;

FIGS. 29 and 30 are a top plan view and a front elevational view respectively of the elements of FIG. 28; and FIG. 31 is a partly broken away, perspective view of a rail member forming part of the seat means of FIG. 28.

DETAILED DESCRIPTION OF THE INVENTION

Figure 1:
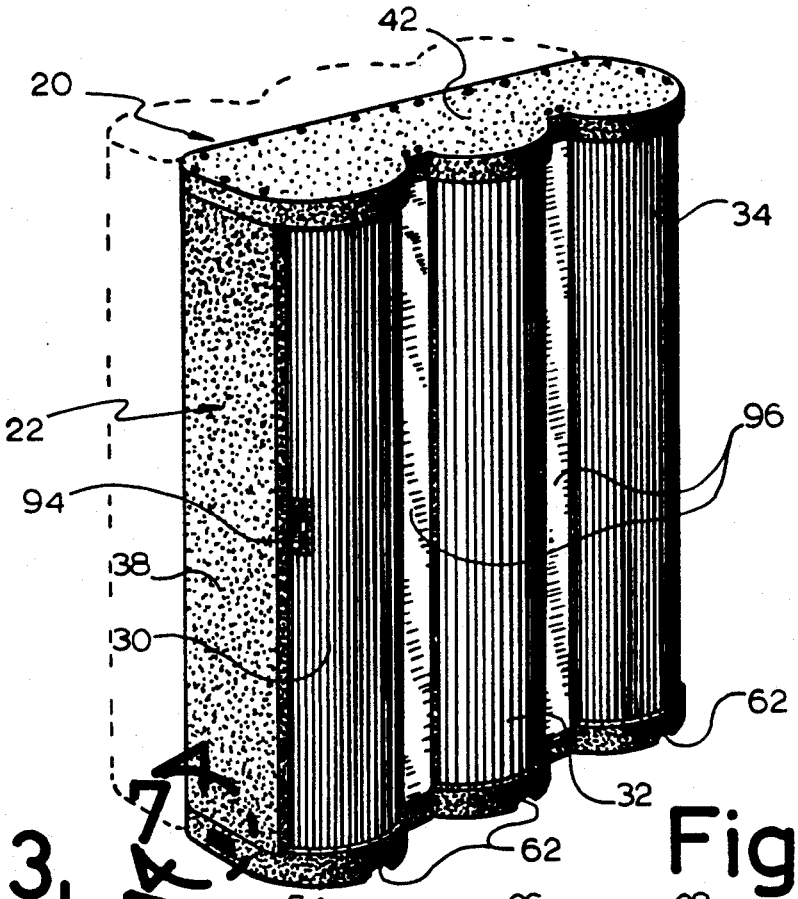
FIG. 1 is a perspective view of an assembly of three interconnected lockers constructed in accordance with the teachings of the invention.
Figure 2:
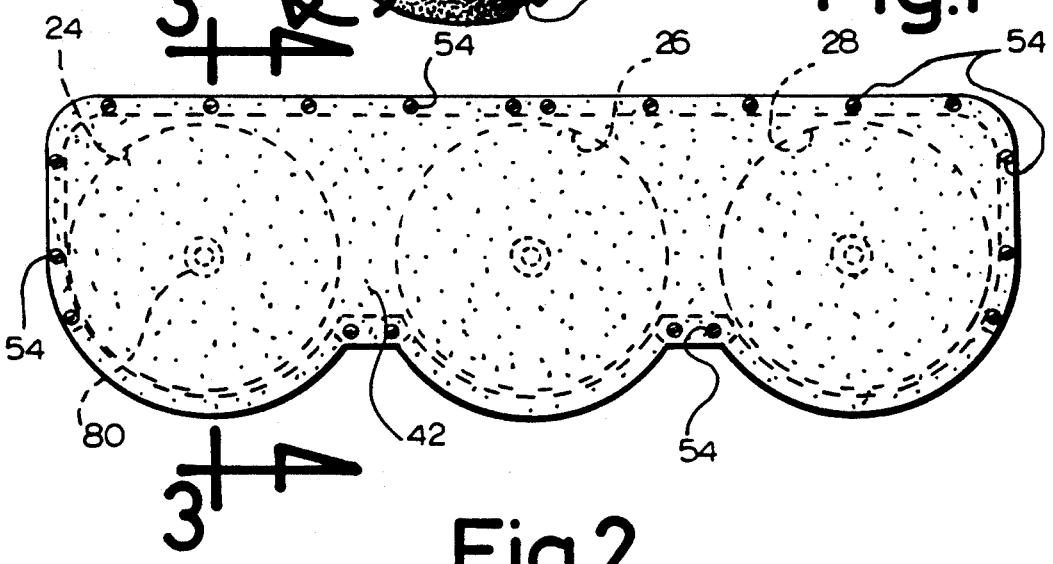
FIG. 2 is a top plan view of the locker assembly.
Figure 6:
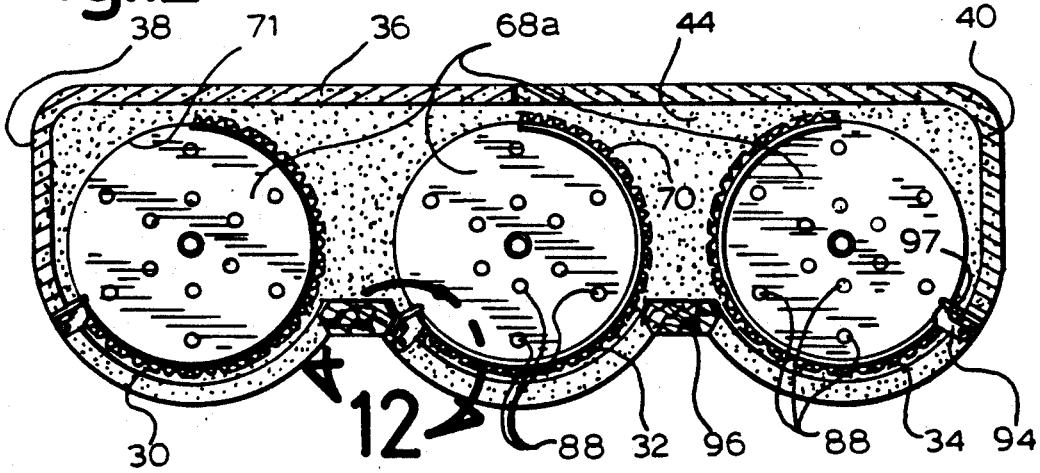
FIG. 6 is a cross-sectional view of the locker assembly, taken along line 6—6 of FIG. 3.
Figure 8:
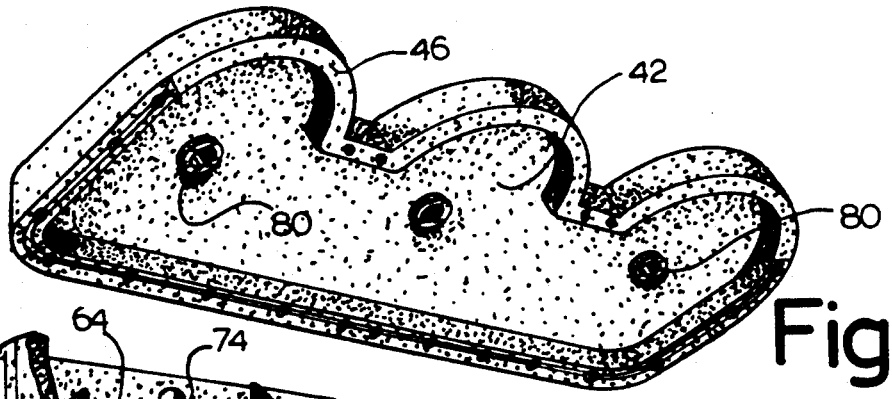
FIGS. 8–9 are perspective views of the top and bottom wall members of one locker, the wall in FIG. 9 being partly broken away.

Locker assembly 20 shown in FIGS. 1–2 and 6 includes a concrete, ground-supported frame 22 enclosing three cylindrical, upstanding, storage areas 24, 26, 28 which transversely open into each other, and semi-cylindrical metallic doors 30, 32, 34 being mounted to the front of frame 22 for gaining access to the storage areas 24, 26, 28 respectively. Frame 22 defines three separate sections:

(a) a main section, consisting of a large, vertical, rear wall 36 (FIG. 3) and two side walls 38, 40 edgewisely mounted integrally to the rear wall orthogonally thereto;

(b) a top wall member section 42, edgewisely abutting against walls 36–40; and (c) a bottom wall member section 44, edgewisely supporting walls 36–40.

Figure 4:
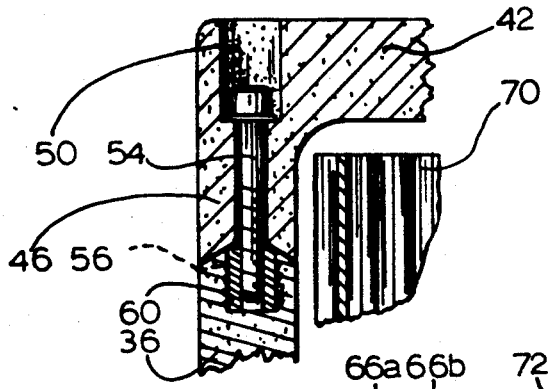
FIGS. 4–5 are views of the areas circumscribed by circles 4 and 5 respectively of FIG. 3.

Top wall member 42 includes a peripheral downturned flange 46, and bottom wall member 44 includes a peripheral upturned flange 48. Each flange 46, 48 includes a plurality of spaced, lengthwise countersunk-bores 50, 52 (FIG. 4) for bolts 54. Walls 36–40 have in turn a plurality of threaded bores 56, 58 at their top and bottom edges, into each of which bores is threadedly, lockingly engaged a nut 60. Each top bore 56 is destined to register with a selected top countersunk-bore 50, and each bottom bore 58 is destined to register with a selected bottom countersunk-bore 52, wherein the respective bolts 54 are to engage the corresponding nuts 60, anchoring top and bottom wall members 42, 44 to the main frame section 36, 40.

Preferably, bottom wall 44 is downwardly forwardly inclined, and the front section 48*a* of lower flange 48 includes a corner drain hole 62, for escape of water from the flooring 44 of the lockers 24, 26, 28.

Figure 3:
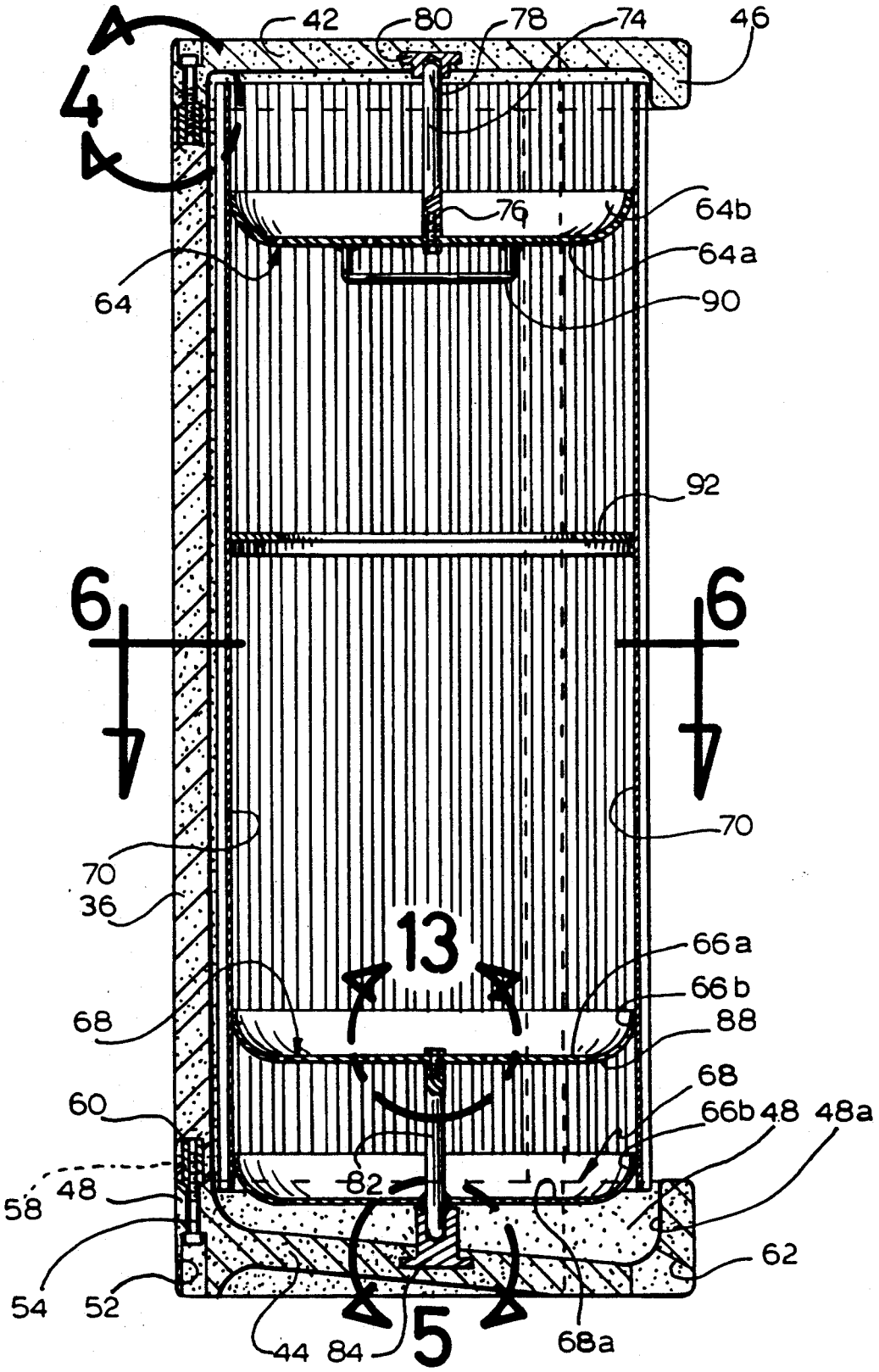
FIG. 3 is a vertical, sectional view of one locker, taken along line 3—3 of FIG. 2.
Figure 10:
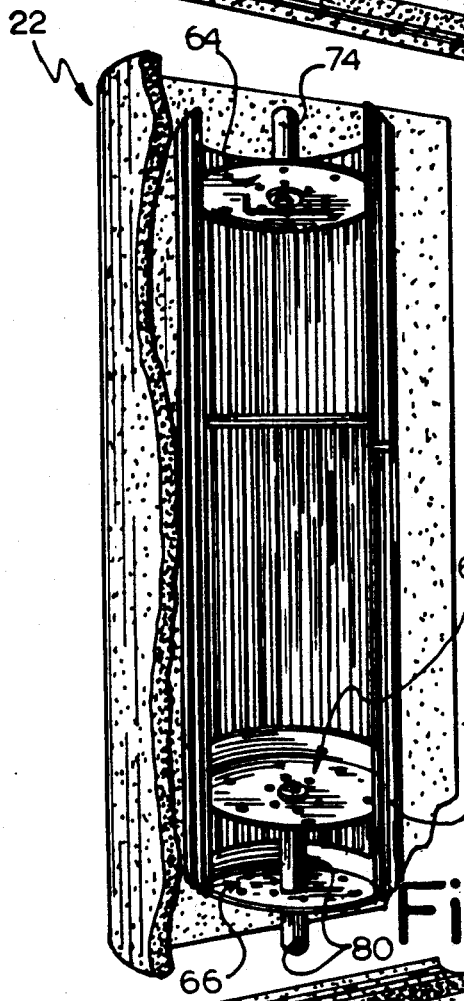
FIG. 10 is a partly broken away, front, elevational view of a locker according to the invention.
Figure 11:
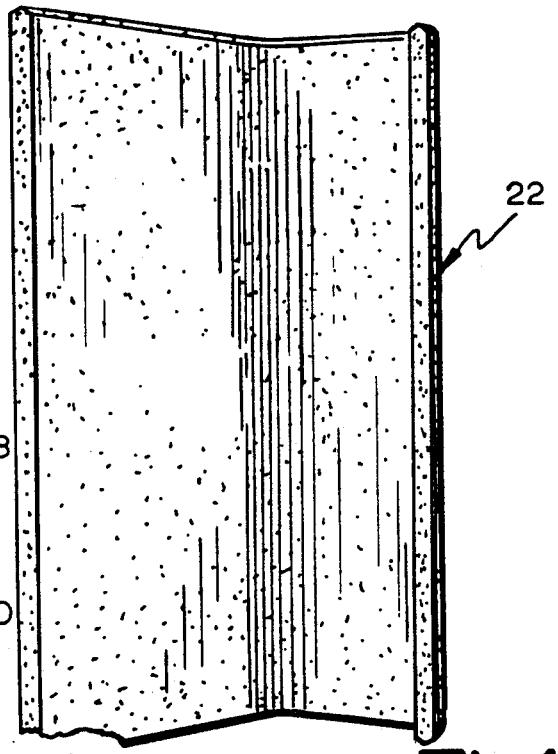
FIG. 11 is a front, elevational view of the exterior concrete frame portion enclosing one locker of the invention.
Figure 9:
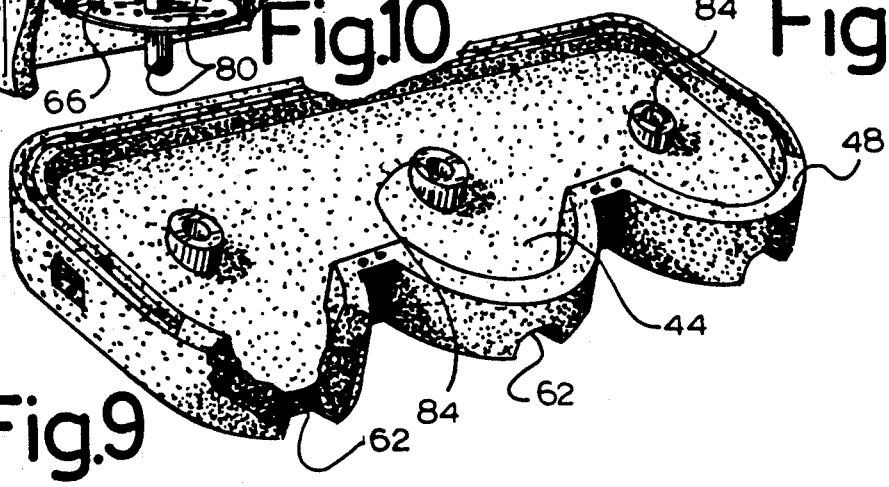
Figure 14:
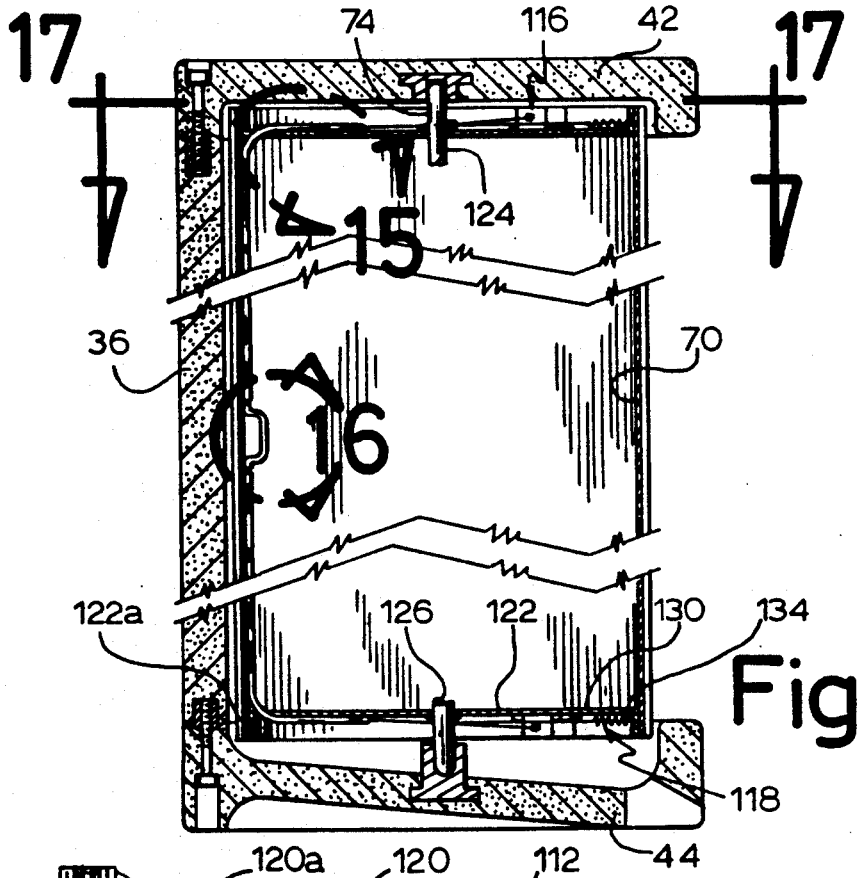
FIG. 14 is a broken away, sectional elevation similar to FIG. 3, but showing a preferred door lock release mechanism to be operated within the closet.
Figure 15:
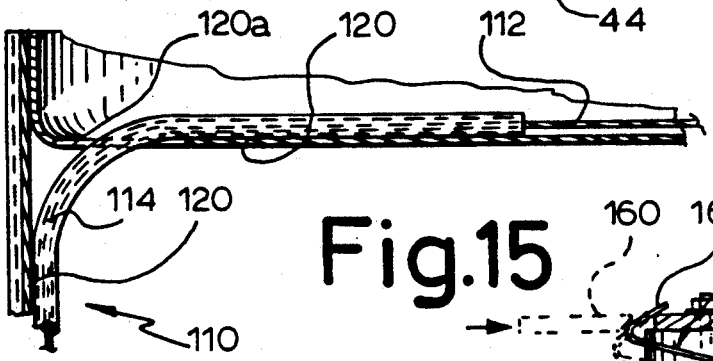
FIG. 15 is a view of the area circumscribed by circle 15 of FIG. 14.

As clearly illustrated in FIGS. 3 and 10, each locker 24, 26, 28 includes a circular strut or shelf members 64, 66, 68, around which is mounted, e.g. by welding, a quadrangular curtain or door member 70. Each curtain 70 extends for slightly more than half the periphery of lockers 24–28, wherein a vertical mouth 71 is defined (FIG. 6). Each strut or shelf 64–68 defines a saucer shape, i.e. a flat disc portion 64*a*–68*a* with an annular peripheral flange 64*b*–68*b*. Three saucers 64–68 are provided. Each have upwardly-inclined flanges 64*b*–68*b*. More particularly, the top saucer 64 is connected to the top wall 42 by a stem 74. The stem has a screw at its bottom edge 76 engaging the center of disc 64a, and rotatably engaged at its top end 78 within a bushing 80 which is embedded into wall 42. The stem 82 of lower shelf 66 is similarly anchored to central area 72 of disc 66a and rotatably mounted into a block 84 embedded into bottom wall 44, the plane of block 84 being offset relative to that of sloped flooring 44 so as to support stem 84 vertically, see FIG. 3 at the bottom. Bottom shelf 68 is also mounted to stem 82, between shelf 66 and flooring 44, by having the stem 68 extend through the center of the disc, and welded thereto at 86, at a suitable position spaced from the overlying saucer-shaped shelf 66.

Flanges 64b–68b constitute circular guides for the curtains 70 to which the curtains are fixedly secured e.g. by welding. Moreover, these shelf members can be used as vertically-spaced trays for supporting clothing, school books, and like items which items are easily accessible when the door is opened. It is envisioned that the discs 64a–68a have a few through-bores 88 enabling water to escape from soaked clothing and drip down to flooring 44. The flooring 44 is sloped therealong, to allow water to escape from the locker assembly 20 through front outlet ports 62 (one for each storage areas 24–28). These flanges 64b–68b are also reinforcement means, for reinforcing the cylindrical structure of the door or curtain 70. There is also a rigid, reinforcing collar member 92, on the inner face of curtains 70 intermediate shelves 64 and 68.

Figure 12:
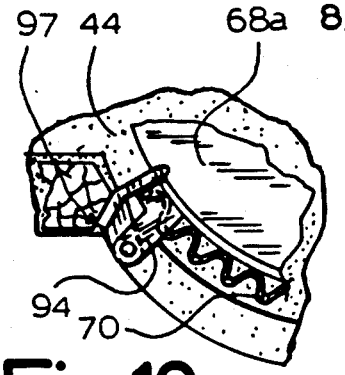
FIG. 12 is an enlarged view of the area circumscribed by circle 12 in FIG. 6.
Figure 5:
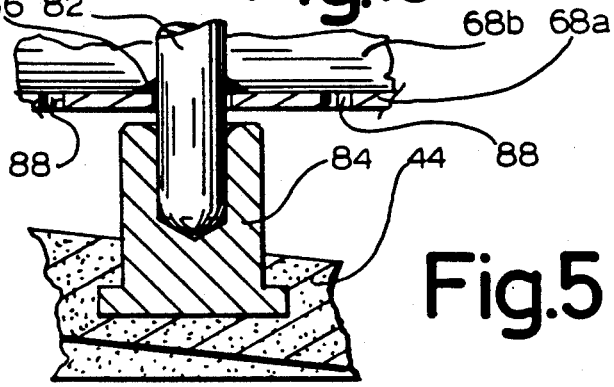

As shown in FIGS. 6 and 12, each curtain 70 is preferably corrugated, i.e. wavy in cross-section, to reinforcing the curtain and to discourage vandalism. Each door should further include a transverse handle 94 on the exterior face thereof, at mid-height, for maneuvering the door in its lateral sliding action between a closed position, shown in FIG. 1 as closing the front opening of casing 22, and an opened position clearing said front opening for access to storage areas 24, 26 or 28. Doors 30–34 are anchored by the flanges 64b–68b of their respective saucer-shaped struts 64–68, and their bottom edges extend above flooring 44.

The front edge sections of the top wall member 42 and the bottom wall member 44 should be formed with semi-circular projections 42a, 44a corresponding to the number of lockers 24–28. The projections conform to the exterior convex shape of the doors 30–34, see FIG. 1. Of course, the fact that the closed doors 30–34 are convex (when viewed from the outside) increases still more the structural integrity of the locker assembly 20 and thus its resistance to physical abuse (e.g. kicks or other blows thereagainst) from would-be vandals.

It should be understood that, although an assembly 20 of three interconnected lockers has been shown as a preferred embodiment two, four or more interconnected lockers could benefit as well from the teachings of the invention. Thus when there is more than one locker, wooden beams or the like 96 should be added vertically between each pair of doors, e.g. 30 and 32, and 32 and 34 in FIG. 1, and anchored by bolts 54 (FIG. 2) to the top and bottom walls 42, 44 preventing sidewise access to the storage areas 24–28.

As shown in FIG. 6 the length of the doors 30–34 and their positions relative to each other require that one locker storage area (24, 26 or 28) should never be accessible from the adjacent areas. Thus, in the embodiment of FIG. 6, the length of a door is about 5/4 $\pi$R, where R is the radius of curvature of the door around the saucer-shaped shelves 64–68 and the door surrounds for more than half the peripheral edge of these shelves. The first two closed doors 30, 32 must extend into casing 22 to the right thereof, with the corresponding handles 94 being at the left, while the last closed door 34 must extend into casing 22 to the left thereof with the corresponding handles being at the right. The handle of door 30 abuts against the front edge of wall 38, the handle of door 34, against the front edge of wall 40, and the handle of door 32, against the wooden beam 94 (FIG. 12) extending between doors 30 and 32.

The wooden beams 96 constitute a front wall for locker assembly 20.

Each handle 94 is to releasably secured to a bracket 97, anchored to walls 38, 40 and 96 when the corresponding door is closed, by any conventional padlock (not illustrated), in the known fashion.

Figure 7:
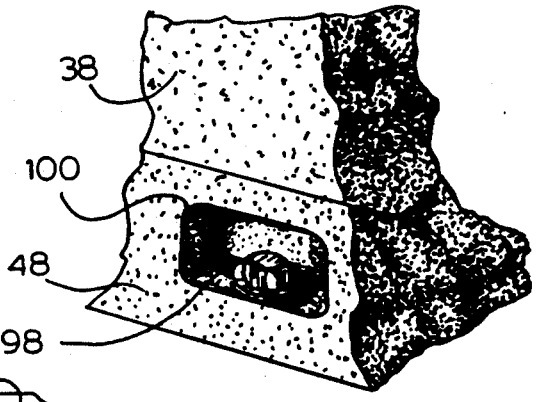
FIG. 7 is a view of the area circumscribed by circle 7 in FIG. 1.
Figure 13:
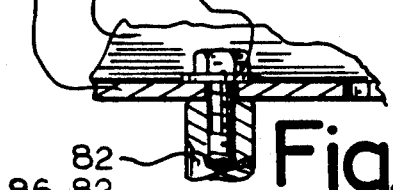
FIG. 13 is a view of the area circumscribed by circle 13 in FIG. 3.

It is envisioned that the concrete base 48 of locker assembly 20 will be anchored to the ground by bolts 98 (FIG. 7) mounted in a cavity well 100 of wall 48 and opening outwardly thereof, wherein screwing/unscrewing thereof is possible with a ratchet tool.

Figure 16:
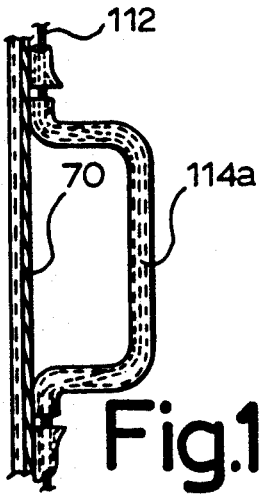
FIGS. 16 and 16*a* are views of the area circumscribed by circle 16 in FIG. 14, sequentially showing how the handle of the door lock release mechanism can be manually actuated.
Figure 16A:
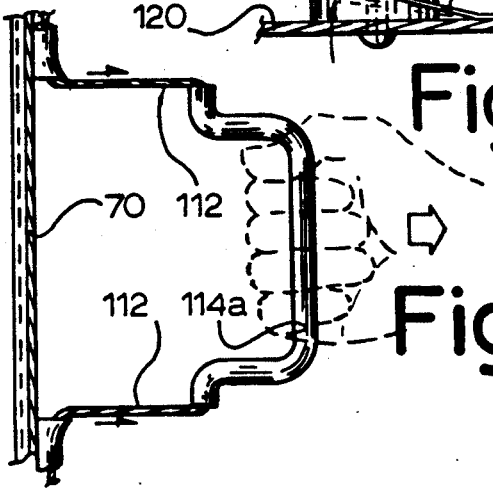

Emergency door unlocking and opening means 110 shown in FIGS. 14–19 includes a cable 112, slidably mounted into an elongated sheath 114 which extends vertically along the inner face of the rear section of door 70 and forwardly therefrom at the top and bottom edges thereof. The cable 112 is to be secured at both ends to springs 128, 130 themselves secured to top and bottom walls 120, 122. Sheath 114 is itself anchored (e.g. glued) to movable door 70. A small section of sheath 114a is sectionally made independent from the remainder thereof and from door 70 (no glue at this section 114a), wherein by pulling section 114a cable 112 will be pulled in equal increments at the top and bottom sections thereof, thanks to the play provided by said anchor members 116, 118 (as will be detailed below). Sheath section 114a is preferably preformed into a U-shape, so as to constitute a handle facilitating handling thereof, see FIGS. 16–16a.

Top and bottom partitions 120, 122 are edgewisely mounted to door 70 for rotation therewith around vertical posts 124, 126. Sheath 114, including cable 112, extends through apertures 120a, 122a made in partitions 120, 122. The ends of cable 112 are secured to coil springs 128, 130 themselves anchored to partitions 120, 122 via anchor pins 132, 134. A supplemental cable section 136, 137 is added to each cable end section spacedly from springs 128, 130 and anchored at its outer end to a plunger 138, 140. Each plunger 138, 140 is part of an electro-magnetic coil or solenoid 142, 144 which are anchored to the top and bottom faces of partitions 120, 122 respectively.

Plungers 138, 140 are biased by a coil spring 141, 141a, to engage cavities 146, 148 made concrete casings 96 proximate the door opening 150 to automatically lock the door upon closing the same. To unlock the door, a magnetic card 151 is inserted within a box 153 and the card reader actuates a switch in box 152 for closing the circuit to the solenoids 142, 144 which retract the plungers 138, 140 against the action of coil springs 141. This door locking mechanism is conventional. Wires 143 leading to the solenoids 142 are coiled to permit rotation of the solenoid operated plungers with the doors 30, 32 or 34.

Idle rollers 154, 156 are rotatably dependent from the top and bottom faces of partitions 120, 122, proximate posts 124, 126 respectively, and substantially coaxial with the posts.

Cable 112 tangentially engages rollers 154, 156 under tension from springs 128, 130, while cable sections 136, 137 are loose when handle 114*a* is released. Plungers 138, 140 will automatically engage into concrete casing top and bottom cavities 146, 148 when the door 70 is swung to its closed position, thanks to bevels 138*a*, 140*a* at the free ends of plungers 138, 140 and to bevels 96*a* on the inner walls of concrete front wall section 96. Indeed, if the door 70 is closed with some force, the plungers 138, 140 will strike with some speed bevelled walls 96*a* laterally with their top and bottom bevelled edges 138*a*, 140*a* thus temporarily retracting against the bias of springs 141, 141*a*. Once plungers 138, 140 register with cavities 146, 148, they will engage therein, so as to lock door 70 in closed position, while a door stopper 158 will concurrently abut against the front edge 38*a* of concrete wall 38.

Figure 17:
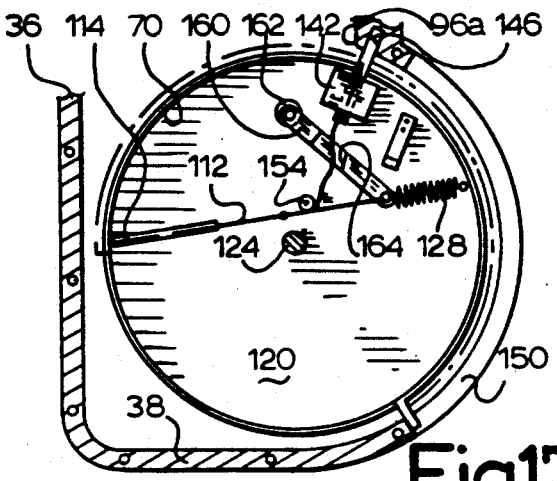
FIGS. 17, 17*a*, 17*b*, 17*c* are cross-sectional views taken along lines 17—17 of FIG. 14, showing how the door lock release mechanism operates in different conditions.
Figure 17A:
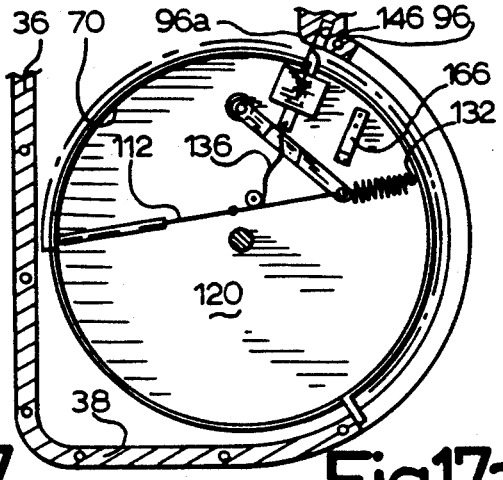
Figure 17B:
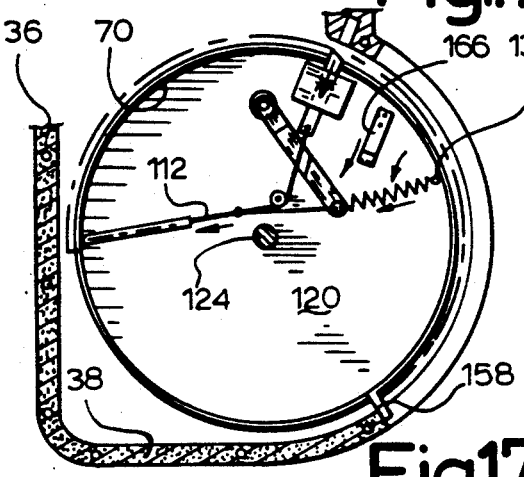
Figure 17C:
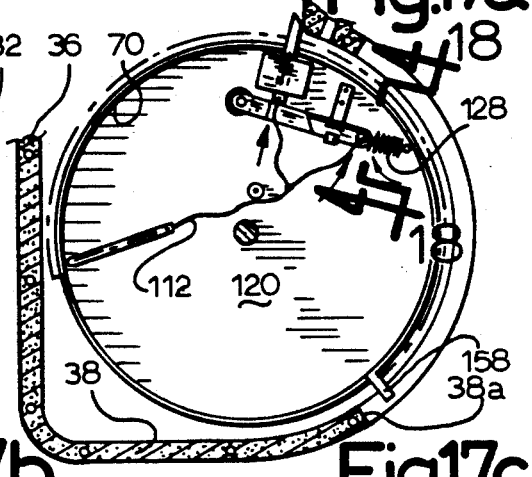
Figure 19:
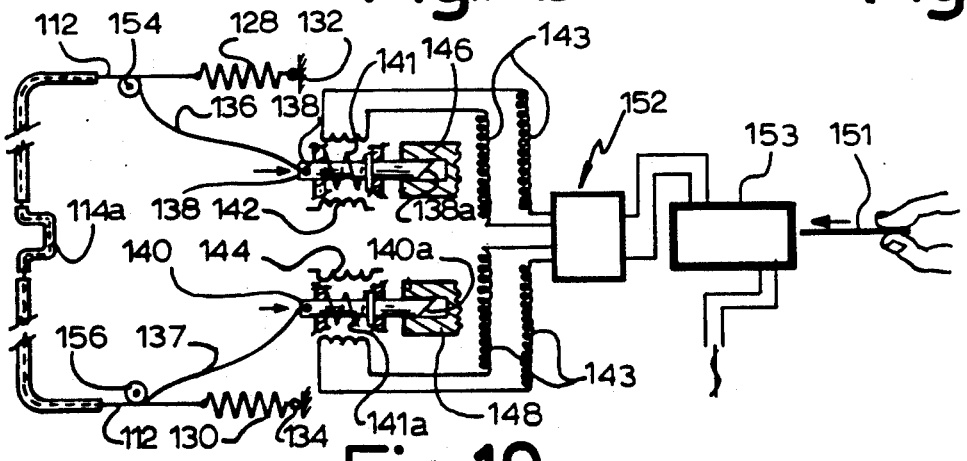
FIG. 19 is a schematic view of the door lock release mechanism.
Figure 21:
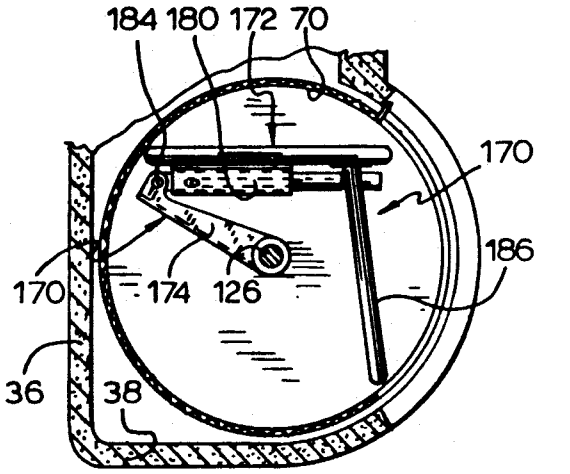
FIGS. 21–21*a* are top plan views of the elements in FIGS. 20–20*a* respectively, from under the intermediate saucer-shape shelf.
Figure 21A:
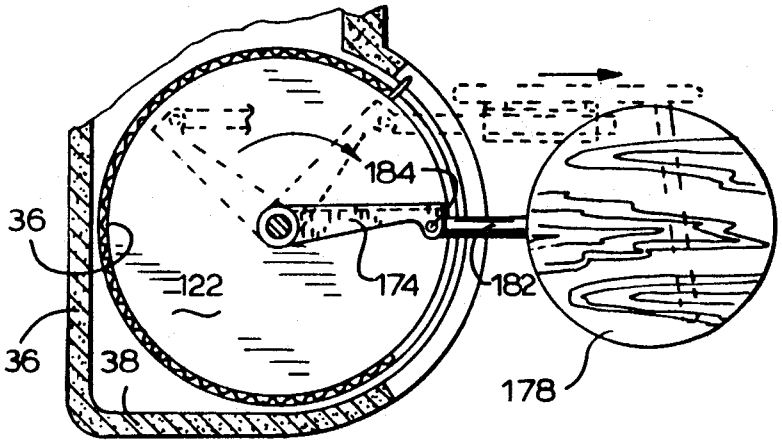

When handle 114*a* is pulled, e.g. by someone trapped inside the locker, cable sections 136, 137 will be tensioned around rollers 154, 156 and will pull plungers 138, 140 outwardly from cavities 146, 148 against the bias of springs 141, 141*a* thus enabling the opening of door 70 (FIG. 17*b*).

Figure 18:
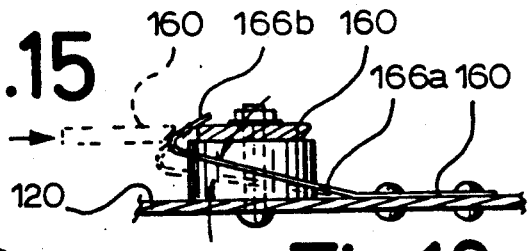
FIG. 18 is a partial sectional view of the lever means of the door lock release mechanism, taken along broken lines 18—18 of FIG. 17*c*.

If someone cuts the cable 112 and then tries to trap another person inside the locker, there is means to prevent door locking. These means includes spring 128, in combination with a lever 160 which is pivotally carried at 162 by the top face of wall 120, between of the axis joining post 124 and solenoid 142 relative to spring 128. The lever 160 is connected at its outer end to the inner end of spring 128. Lever 160 includes a transverse notch 164 for free passage of cable segment 136 but is in the path of plunger 138. A hook 166 is anchored to partition 120 proximate door 70, in between solenoid 142 and pin 132. Hook 166, as shown in FIG. 18, consists of an elongated, flexible resilient metal blade fixed to top wall 120 parallel to plunger 138 and having a bent outer section 166*a* i.e. spacedly diverging by about 30° from wall 120. The free end section of blade 166 at 166*b* is upwardly bent so as to make an acute angle with leg 166*a*. Bent section 166*b* should not normally come in contact therewith because the length of cable 112 is such as to keep lever 160 away from hook 166 despite the tension of springs 128 and 130. However, should cable 112 be cut, the spring 128 will then retract and pull on the outer end of lever 160 which will transversely slide along the top face of flexible blade leg 166*b*. The latter will then downwardly yield (dotted lines in FIG. 18) and will thereafter return to its raised position (full lines in FIG. 18) to hook on lever 160, so that it remains substantially orthogonal to and transversely abutting against plunger 138 to lock the latter into an outward position. Thus, even if the door 70 is forcibly swung toward its closed position, the plunger 138 striking concrete edge 96*a* will not retract and one will not be able to close the door.

Figure 20:
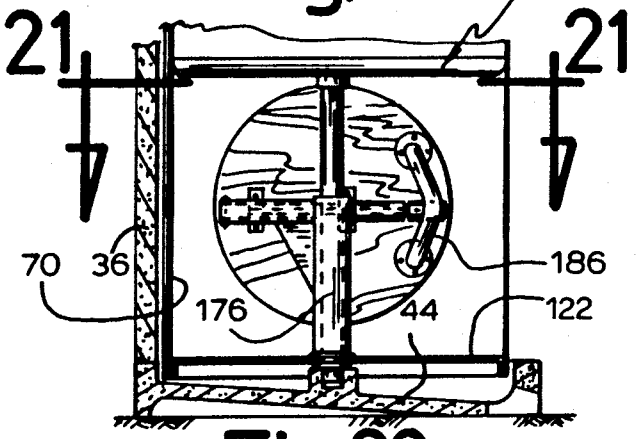
FIGS. 20–20*a* are broken away, vertical sectional elevations of the closet lower section, but showing a first embodiment of seat means sequentially illustrated in its inoperative and operative conditions.
Figure 20A:
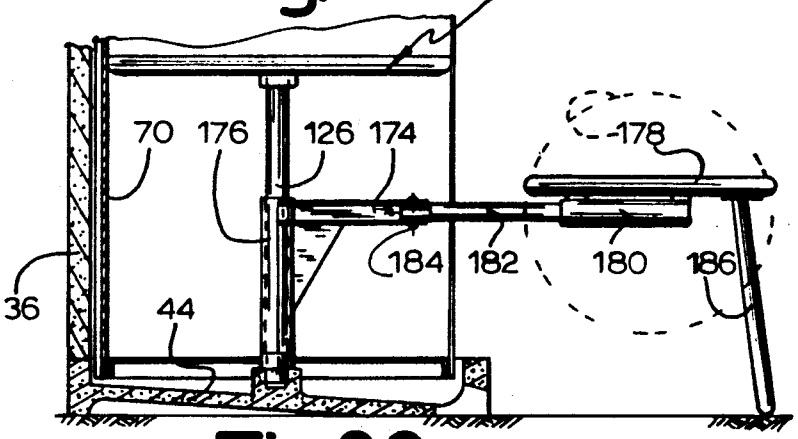

The locker may be provided with a seat which folds within the locker when not in use. Various seats are suggested in FIGS. 20–31. In FIGS. 20–21, 20*a*–21*a*, there is shown a foldable seat 170 carried by a pivot arm 174 which is integrally connected to a sleeve 176 rotatably mounted around lower post 126. Panel assembly 172 includes: a circular wooden panel 178, anchored to a cylindrical body 180; a rod member 182, anchored at one end to the pivot mount 184 of pivotal arm 174, and slidably engaged within cylinder 180; and a foot 186, transversely anchored to panel 178 in outwardly divergent fashion. Arm 174 may pivot from a retracted position shown in FIG. 21 to an extended position shown in FIG. 21*a*. Cylinder 180 may slide along rod 182 from an inner position shown in FIG. 21, to a fully extended condition shown in FIG. 20*a* where it extends outwardly of the locker. Seat panel 178 may pivot from a vertical inoperative position (FIG. 20) to a horizontal operative position (FIG. 20*a*), where it is supported over ground by leg 186. A pin (not shown) fixed to sleeve 180 engages a longitudinal groove made in rod 182 and communicating with an annular groove in rod 182 to limit extension of sleeve 180 while permitting its rotation at the end of its extension. Leg 186 in its inoperative position is parallel to floor 122, as shown in FIG. 20. The seat assembly, when in folded stored position, is within the confines of a compartment defined by the lower portion of door curtain 70 and of floor 122 and shelf 68 fixed thereto. The door can therefore be closed.

Figures 22, 22A, 23, 24, 25:
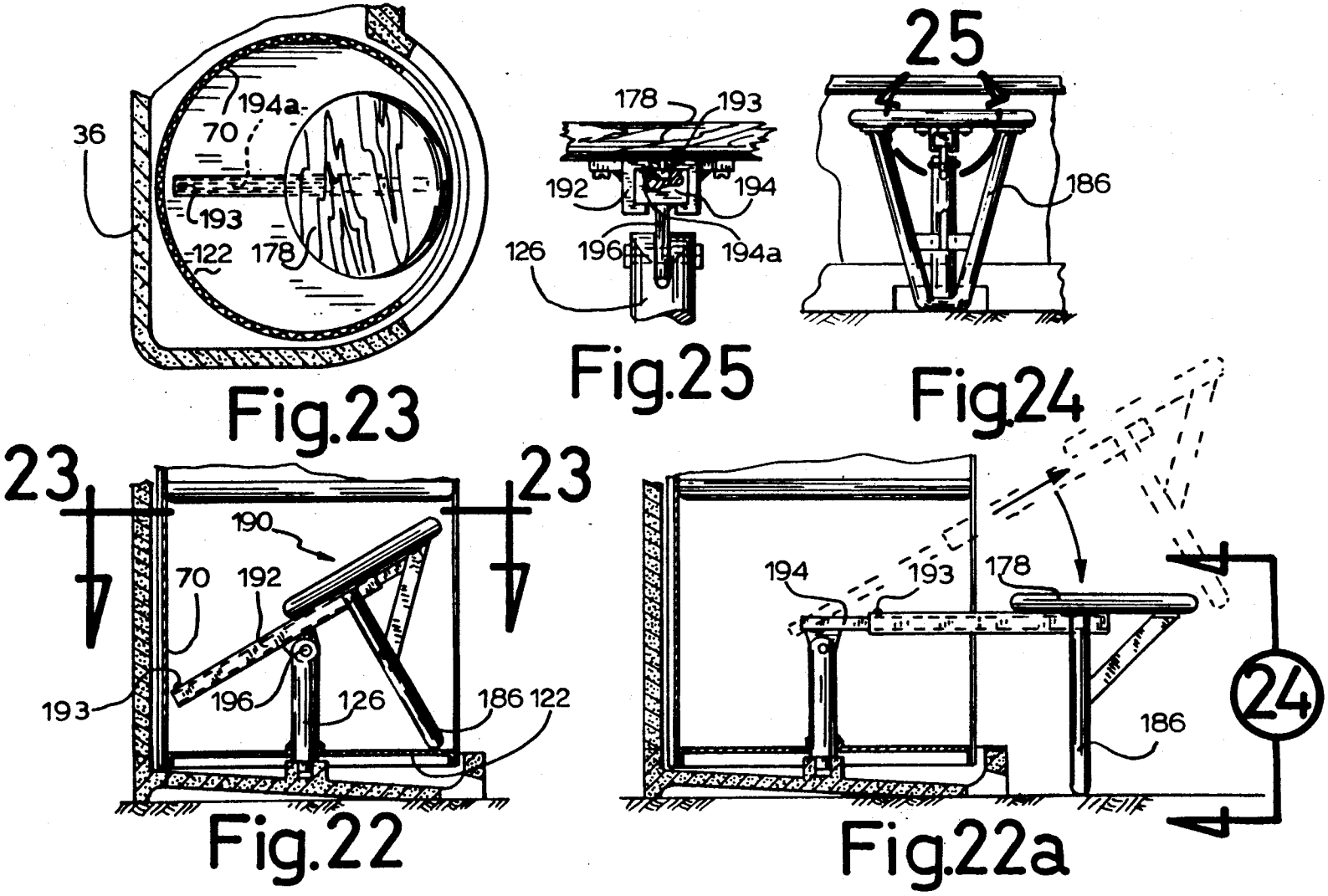
FIGS. 22–22*a* are views similar to that of FIGS. 20–20*a* but for a second embodiment of seat means.
FIG. 23 is a top plan view of the elements of FIG. 22, from under the intermediate saucer shape shelf.
FIG. 24 is a front elevational view taken from line 24 of FIG. 22*a*.
FIG. 25 is a view of the area circumscribed by circle 25 in FIG. 24.
Figure 27A:
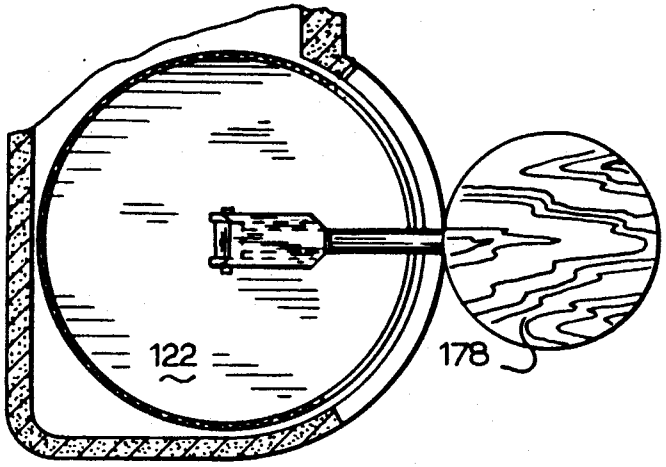
FIGS. 26–26*a* and 27–27*a* are views similar to that of FIGS. 20–20*a* and 21–21*a* but for a third embodiment of the seat means.

In the second embodiment of seat means 190 shown in FIGS. 22–25, 22*a*, seat panel 178 is flatly anchored to one end section of a cross-sectionally C-shape rail member 192, which, as best shown in FIG. 25. Rail member 192 is slidably engaged around a cross-sectionally quadrangular bar 194. Member 192 carries a pin 193 engaging a longitudinal blind groove 194*a* in bar 194 to prevent disengagement of members 192. An end section of bar 194 is pivotally carried to the top end of post 126 by a pivot mount 196, for pivotal motion about a horizontal axis. Thus, tube 192 is slidable from an inner position shown in FIG. 22 to a fully extended condition shown in FIG. 22*a*, along bar 194. The wooden panel 178 and foot 186 are not pivotable, thus they take more storage space in the locker than the first seat means 170 of FIGS. 20, 21. Foot 186 may be V-shape, as shown in FIG. 24.

Figure 26A:
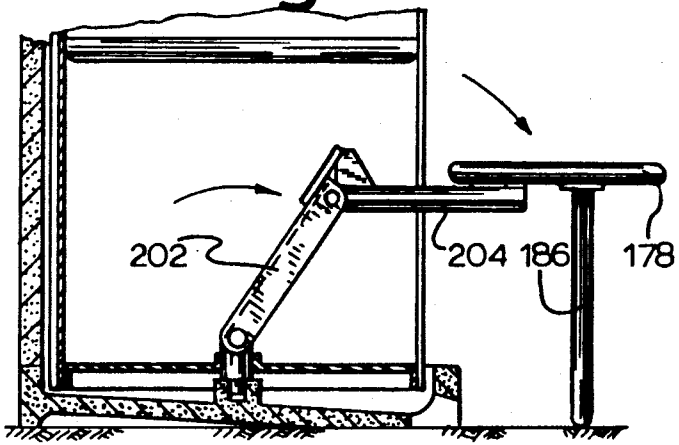
Figure 27:
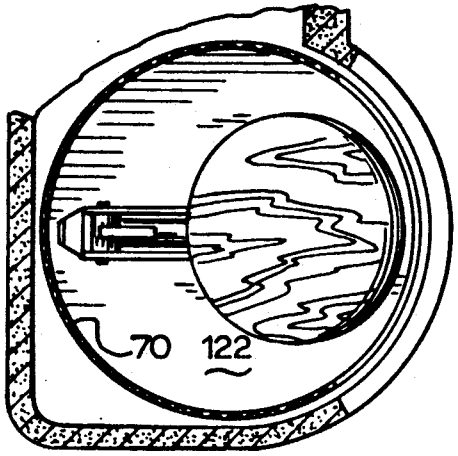
Figure 26:
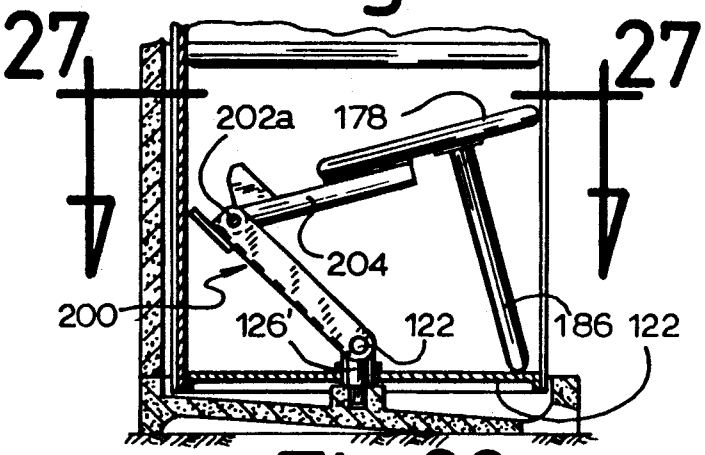

In the third embodiment of seat means 200 shown in FIGS. 26, 27, 26*a*, 27*a*, the post 126′ journalled within concrete base 44 and fixed to floor 122 is much shorter, to give more space upward, and a pivotal arm 202 is mounted at one end to post 126′ and at the other end to a rod 204. Rod 204 is anchored at its outer end to seat panel 178. Pivot mounts 202*a*, 202*b* of arm 202 enable relative motion of arm 202 and rod 204 about horizontal axes. The extension of seat means 200 from its retracted position of FIG. 26 to its fully extended position of FIG. 26*a* is permitted solely by the pivotal motion of lower arm 202 by almost 90°, while rod 204 remains substantially horizontal. Abutment plate 203 fixed to arm 202 abuts a flange 205 fixed to rod 204 in the extended position of the seat assembly to maintain seat 178 horizontal and leg 186 vertical.

In the last embodiment of the seat means 210 shown in FIGS. 28–31, a wooden panel 178 is carried by a U-shape foot 186. Bottom ends of the legs 211, 213 of the foot are anchored to two spaced horizontal tubular bars 220. These bars 220 are slidably engaged into hollow tubular members 216, 218 which are anchored to flooring 122 substantially parallel to concrete wall 38 when the door is fully opened. The foot legs 211, 213 engage through slits 216*a*, 218*a* made in the top walls of anchor elements 216, 218. A bar 224 is slidable within tube 220. The panel 178 remains horizontal in its inoperative and operative positions. Each tubular member 220 has a transverse finger 222 engaging a longitudinal groove 226 of a bar member 224 for limiting extension of tube 220 relative to bar 224. A stop 228 is fixed to the inner end of tube 224 and abuts anchor tubes 216, 218 in the fully retracted position of tube 224. Tube 224 reinforces the telescopic assembly such that the seat does not require a ground engaging leg.

We claim:

1. A closet for use as a locker for storage of items such as clothing, school books and the like, said closet consisting of:

(a) a closed, hollow, rigid frame, defining a ground standing casing including a front wall and top and bottom walls, at least one door wall opening being made into said front wall;

(b) a rigid door for each said door wall opening, said door being of substantially semi-cylindrical shape; and (c) mounting means, for securing said door to said frame, said door being movable relative to said frame between a closed position, completely closing said door wall opening so as to be convex when viewed from the outside, and an open position, substantially clearing said door wall opening; said mounting means including: an upper saucer-shaped disc member, having an upwardly extending transverse first shaft rotatably mounted to said top wall so that said upper disc member is spaced from the top wall at least one lower saucer shaped disc member, having a downwardly extending second shaft rotatably mounted to said bottom wall and so that said lower disc member is spaced from the bottom wall, said second shaft is coaxial with said first shaft; and securing means, for anchoring said disc members to said semi-cylindrical door, said door rotatable around the common axis of said first and second shafts, and the door opening action shifting the door inside said closed frame to completely disappear therein so as to be concealed; the opened door being much less likely to sustain physical abuse from vandals;

said door being releasably locked in said closed position, said mounting means beyond reach with said door in said closed position, said closet being characterized by its resistance to physical abuse from vandals;

wherein there are at least two door wall openings and a corresponding number of doors, and further including at least two cylindrical storage areas each being constituted within the volume defined by a given semi-cylindrical door, the relative position and length of said door with respect to its open and closed positions being such that each said storage area remains constantly beyond reach of any adjacent storage area.

2. A closet as defined in claim 1, further including locking means to lock the door to said rigid frame, and door release means to inactivate said locking means, said locking means and said door release means carried by said door.

3. A closet as in claim 2, wherein said door release means includes cable means carried by said door and operatively connected to said locking means, and handle means to manually operate said cable means whereby by pulling said handle means, one can disengage said door locking means.

4. A closet as in claim 3, wherein said door locking means includes a solenoid operated plunger, spring biased to locking position and attached to, to be retracted to unlocking position upon pulling said handle means, a lever pivoted to said door in the path of said plunger and means responsive to cutting of the said cable means to pivot said lever to a position preventing plunger retraction and hook means carried by said disc to keep said lever in said locking position.

5. A closet as in claim 1, further including seat means to be mounted into said closet, wherein said seat means includes motion means for relative motion of the seat means relative to said door between an inoperative stacked condition, within the bounds of said closed door, to an operative extended condition in which a major portion of the seat means extends outwardly through the rigid frame opening of the opened door.

6. A closet as in claim 5, with said seat means further including a seat panel and a foot depending from said seat panel engaging the ground outwardly of said closet in the operative extended condition of the seat means so as to support the weight of a person sitting on said seat panel.

7. A closet as in claim 5, with said seat means further including a support frame and a seat panel carried by said support frame wherein said motion means includes first pivot means for pivotal motion of the support frame about a vertical axis second pivot means, for translational motion of said seat panel about a vertical axis concurrently with said first pivot means pivotal motion, and third pivot means for pivotal motion of the seat panel between a vertical stacked position inside the closet and a horizontal operative position outside of the closet.

8. A closet as in claim 5, with said seat means further including a support frame carried by said door and a seat panel carried by said support frame and wherein said motion means includes pivot means for pivotal motion of the support frame about a horizontal axis, and rail means for displacement of the seat panel relative to said support frame.

9. A closet as in claim 5, wherein said motion means further including a pivotal arm pivotally carried at one end by the lower disc for movement about a first horizontal axis and at its other end to a first inner end of a bar for movement about a second horizontal axis, said bar anchored at its second outer end to a seat panel.

10. A closet as in claim 5, wherein said motion means includes rail means mounted to the lower disc for sliding motion of said seat means along a horizontal axis.

* * * * *